United States Patent [19]

Fumio

[11] Patent Number: 4,899,529

[45] Date of Patent: Feb. 13, 1990

[54] METHOD FOR WINDING A COVERED YARN

[75] Inventor: Tanae Fumio, Iyo, Japan

[73] Assignee: Teijin Seiki Co., Ltd., Osaka, Japan

[21] Appl. No.: 283,308

[22] Filed: Dec. 12, 1988

[30] Foreign Application Priority Data

Dec. 22, 1987 [JP] Japan ..... 62-324560

[51] Int. Cl.[4] ..... D01H 13/16; D01H 15/00

[52] U.S. Cl. ..... 57/261; 57/18; 57/80; 57/313; 242/18 R; 242/35.6 R

[58] Field of Search ..... 57/18, 261, 313, 78, 57/80, 99; 242/18 R, 35.6 R

[56] References Cited

U.S. PATENT DOCUMENTS

| | | | |
|---|---|---|---|
| 2,084,101 | 6/1937 | Meadows | 242/177 |
| 3,034,736 | 5/1962 | Rhein | 242/18 R |
| 3,237,391 | 3/1966 | Carruthers | 57/261 X |
| 3,983,687 | 10/1976 | Lewis | 57/18 |
| 4,170,101 | 10/1979 | Bock | 57/261 X |
| 4,391,089 | 7/1983 | Billner et al. | 57/261 |
| 4,525,992 | 7/1985 | Payen | 57/18 |
| 4,771,960 | 9/1988 | Yamamoto et al. | 242/43.1 X |

*Primary Examiner*—Joseph J. Hail, III

*Attorney, Agent, or Firm*—Burgess, Ryan & Wayne

[57] ABSTRACT

A method for winding a covered yarn in a covered yarn manufacturing machine. A non-elastic yarn is supplied from a wrapping yarn bobbin and is wrapped around a core yarn made of an elastic yarn to form a covered yarn. The covered yarn is traversed by a traverse guide along a winding bobbin and is wound around the winding bobbin. The traverse guide is displaced along the winding bobbin to a position outside a normal traversing region when the non-elastic yarn on the wrapping yarn bobbin has almost consumed. Thereafter, the covered yarn manufacturing machine is stopped. Then, the consumed wrapping yarn bobbin of non-elastic yarn at supply is replaced by a new wrapping yarn bobbin of non-elastic yarn. The covered yarn manufacturing machine is restarted. The above-described steps of the displacing, the stopping, the replacing and the restarting are repeated with regard to one winding bobbin. In this case, the positions to which the traverse guide is displaced are gradually away from the normal traversing region as the steps are repeated. Finally, the traverse guide is stopped in the normal traversing region after repeat of the steps to form bunch windings on the package.

2 Claims, 3 Drawing Sheets

METHOD FOR WINDING A COVERED YARN

BACKGROUND OF THE INVENTION

The present invention relates to a method for winding a covered yarn in a covered yarn manufacturing machine. More specifically, the present invention relates to a method for winding a covered yarn in a covered yarn manufacturing machine, wherein a non-elastic yarn supplied from a wrapping yarn bobbin is wrapped around a core yarn made of an elastic yarn to form a covered yarn, and the covered yarn is traversed by a traverse guide along a winding bobbin and is wound around the winding bobbin.

A covered yarn comprises a core yarn made of an elastic yarn and a non-elastic yarn wrapped around the core yarn. When such a covered yarn is manufactured, a hollow bobbin having a non-elastic wrapping yarn wound thereon is rotated so as to wrap the non-elastic yarn around the elastic yarn which passes through a hollow portion of the hollow bobbin.

Since the full amount of the non-elastic yarn wound on a conventional wrapping yarn bobbin is small, for example, about between 300 and 600 g, the winding of the covered yarn is temporally stopped, when the non-elastic yarn wound on the wrapping yarn bobbin is almost consumed. After a new wrapping yarn bobbin is set, the winding of the covered yarn is continued.

According to the above-described conventional method, a plurality of small packages of covered yarn have to be prepared, and thereafter, the plurality of small packages of covered yarn are continuously wound in a single large package in a separate rewinding process so as to enlarge the yarn package.

Accordingly, there was a problem in the conventional method that its process is troublesome because it needs an additional rewinding process.

In order to overcome the above-described problem, the inventor of the present invention has tried a large wrapping yarn bobbin of a non-elastic yarn so as to increase the amount of covered yarn which is continuously wound on a winding bobbin.

However, according to this attempt, the weight of the wrapping yarn of a non-elastic yarn becomes large, and therefore, the rotating speed of the wrapping yarn bobbin cannot be increased. Thus, there occurs a new problem when the speed of the covered yarn manufacturing machine is increased.

OBJECT OF THE INVENTION

It is an object of the present invention to provide a method for winding a covered yarn in a covered yarn manufacturing machine, by which a rewinding process which has been necessary for a conventional method is unnecessary.

It is another object of the present invention to provide a method for winding a covered yarn in a covered yarn manufacturing machine, by which the amount of the covered yarn package wound on a winding bobbin can be enlarged without causing troubles which are often encountered by increase of the winding amount of a wrapping yarn bobbin when the speed of a covered yarn manufacturing machine is increased.

SUMMARY OF THE INVENTION

According to the present invention, the above-described objects are achieved by a method for winding a covered yarn in a covered yarn manufacturing machine, wherein a non-elastic yarn supplied from a wrapping yarn bobbin is wrapped around a core yarn made of an elastic yarn to form a covered yarn, and the covered yarn is traversed by a traverse guide along a winding bobbin and is wound around the winding bobbin.

The method further comprises: displacing the traverse guide along the winding bobbin to a position outside a normal traversing region when the non-elastic yarn on the wrapping yarn bobbin is almost consumed;

thereafter, stopping the covered yarn manufacturing machine;

replacing the consumed wrapping yarn bobbin of non-elastic yarn by a new wrapping yarn bobbin of non-elastic yarn; and restarting the covered yarn manufacturing machine.

BRIEF DESCRIPTION OF THE DRAWINGS

The present invention will now be explained in detail referring to the accompanying drawings, wherein.

DESCRIPTION OF PREFERRED EMBODIMENTS

Before the method of the present invention is explained, the problem inherent to a conventional method for winding a covered yarn will now be explained with reference to FIG. 9.

As it is well known, a covered yarn comprises a core yarn made of an elastic yarn and a non-elastic yarn wrapped around the core yarn.

Figure 9:
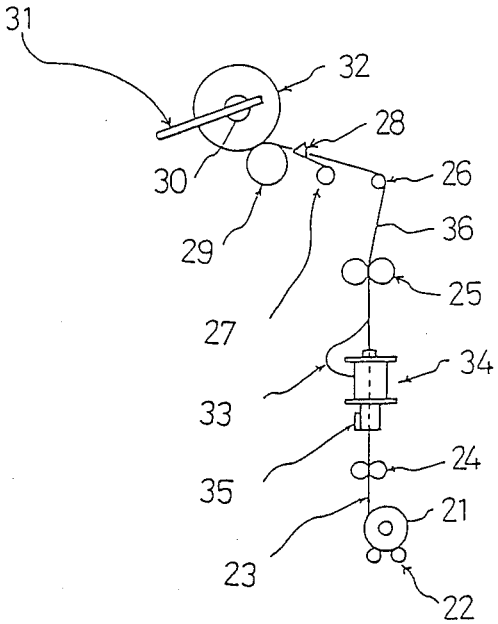
FIG. 9 is a side view showing a method for winding a covered yarn.

When such a covered yarn is manufactured, as illustrated in FIG. 9, a core yarn bobbin 21 of an elastic yarn is rotatably supported on a pair of bobbin support rollers 22. The elastic yarn 23 is withdrawn from the core yarn bobbin 21 by a pair of first feed rollers 24 and a pair of second feed rollers 25.

A hollow bobbin 34 has a non-elastic wrapping yarn 33 wound thereon. The hollow bobbin 34 with the wrapping yarn 33 is rotatably supported at a position between the first feed rollers 24 and the second feed rollers 25 and is rotated by a drive belt 35. When the wrapping yarn bobbin 34 is rotated, the non-elastic yarn 33 is wrapped around the elastic yarn 23 which passes through a hollow portion of the hollow bobbin 34 with the wrapping yarn 33, and a covered yarn 36 is formed.

The covered yarn 36 is fed through a bar guide 26 to a traverse guide 28 of a traverse device 27, by which the covered yarn is traversed to and fro. A winding bobbin 30 is rotatably supported by a package support device 31 and is driven by a winding roller 29.

The covered yarn 36 which has been traversed by the traverse guide 28 is wound onto the winding bobbin 30 to form a package 32.

As described above, conventionally, the full amount of the non-elastic yarn 33 wound on the wrapping yarn bobbin 34 was small, for example, about between 300 and 600 g. Accordingly, when the non-elastic yarn 33 wound on the wrapping yarn bobbin 34 is almost consumed, the winding of the covered yarn 36 is temporally stopped. After a new wrapping yarn bobbin 34 is set, the winding of the covered yarn 36 is continued.

In accordance with the above-described conventional method, a plurality of small packages 32 of a covered yarn have been prepared, and thereafter, the plurality of small packages 32 of covered yarn are continuously wound in a single large package in a separate rewinding machine so as to enlarge the yarn package.

Accordingly, there was a problem in the conventional method that its process is troublesome because it needs a separate rewinding process.

In order to overcome the above-described problem, as described above, the inventor of the present invention has tried an attempt wherein a large wrapping yarn bobbin of a non-elastic yarn is used so as to increase the amount of covered yarn which is continuously wound on a winding bobbin.

However, according to this attempt, the weight of the wrapping yarn of a non-elastic yarn becomes large, and therefore, the rotating speed of the wrapping yarn bobbin cannot be increased. Thus, there occurs a new problem when the covered yarn manufacturing machine is sped up.

The present invention is achieved in order to overcome the above-described problem. Apparatuses for carrying out the winding method of the present invention are illustrated in FIGS. 1 and 2.

Figure 1:
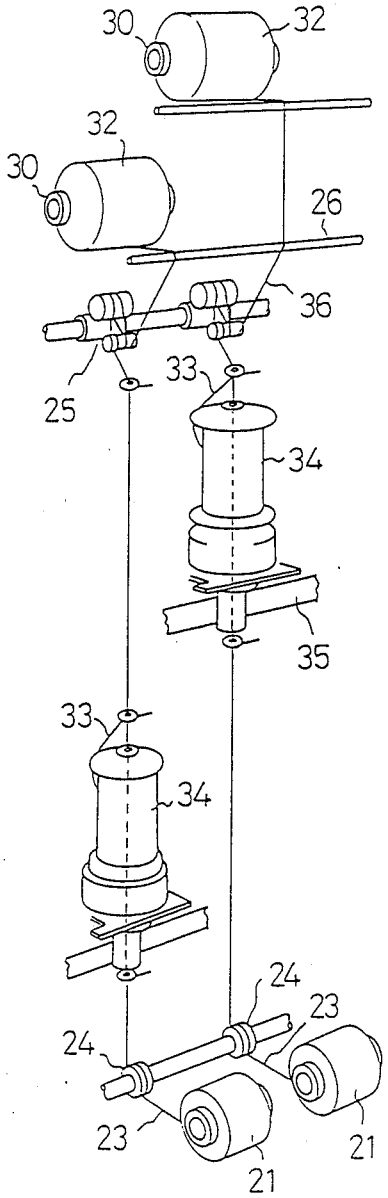
FIGS. 1 and 2 are perspective views showing apparatuses for carrying out the method for winding a covered yarn according to the present invention.
Figure 2:
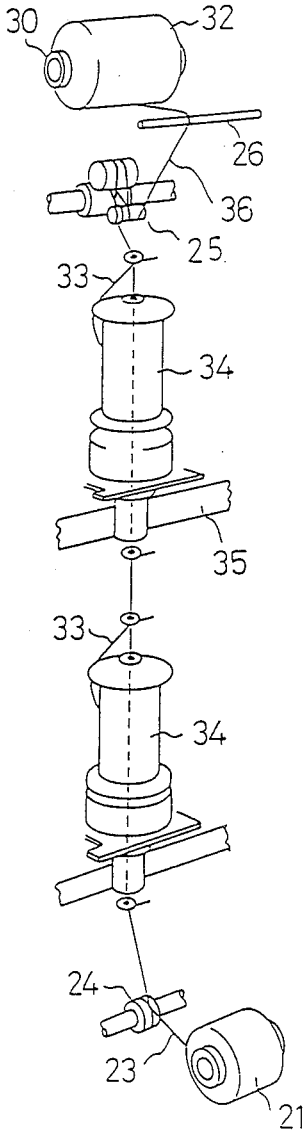

Since the covered yarn manufacturing machines shown in FIGS. 1 and 2 have constructions similar to that illustrated in FIG. 9, like parts are denoted by the same reference numerals and their further explanations are omitted here. Illustration of a traverse device 27 is omitted from FIGS. 1 and 2. The drive mechanism of the traverse device 27 is similar to that disclosed in U.S. Pat. No. 4,771,960 and will now be explained with reference to FIGS. 3 to 5.

The winding roller 29 is connected to a drive source (not shown) so as to be rotated at a constant speed. Yarn winding bobbins 30 are in contact with the winding roller 29 and are rotated thereby.

Traverse guides 28 which perform traverse motion in an axial direction of the bobbin 30 are connected to traverse rods 4. The traverse rods 4 are connected to a means for reversible movement, such as an AC, i.e., alternate current, servo motor 5 (in FIGS. 3 and 4), a DC, i.e., direct current, servo motor, a stepping motor, or a hydraulic cylinder 6 (in FIG. 5).

Figure 3:
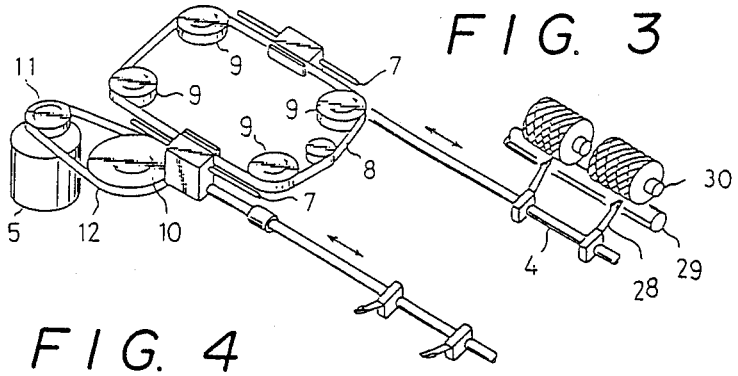
FIGS. 3, 4 and 5 are perspective views showing traverse devices for carrying out the method of the present invention.

More specifically, in FIG. 3, a pair of traverse rods 4 are supported in such a manner that they can reciprocate along guide rails 7, and the traverse rods 4 are connected to each other by means of a transmitting member, such as a timing belt 8. The timing belt 8 is wrapped around pulleys 9. A pulley 10 is coaxially disposed with one of the pulleys 9, a pulley 11 is fixed to the output shaft of the AC servo motor 5, and a transmitting member, such as a timing belt 12, is wrapped around the pulleys 10 and 11. Accordingly, the traverse guides 3 are traversed to and fro along the bobbins 2 by switching the rotating direction of the AC servo motor 5.

Figure 4:
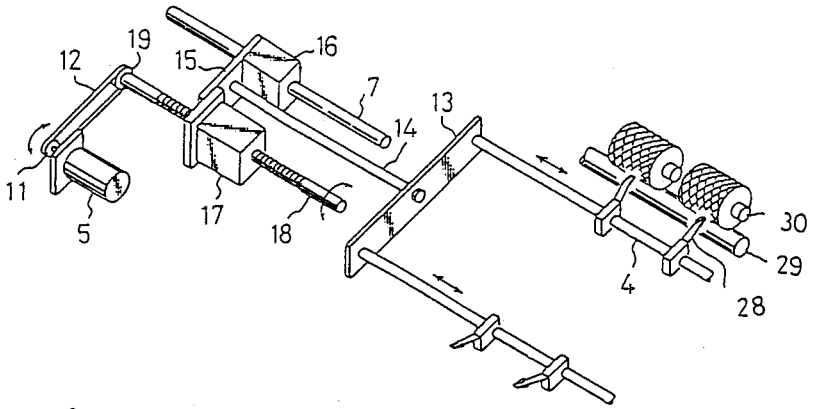

In FIG. 4, a pair of traverse rods 4 are connected to each other by means of a bracket 13, which is connected to another bracket 15 via a connecting rod 14.

The bracket 15 extends between a slide block 16, which is movable along the guide rail 7, and a block 17, which is movable along a screw shaft 18. A transmitting member, such as a timing belt 12, is wrapped around a pulley 19, which is fixed to an end of the screw shaft 18, and a pulley 11, which is fixed to an output shaft of the AC servo motor 5. Accordingly, the traverse guides 3 are traversed to and fro along the bobbins 2 by switching the rotating direction of the AC servo motor 5, and accordingly, the rotating direction of the screw shaft 18.

Figure 5:
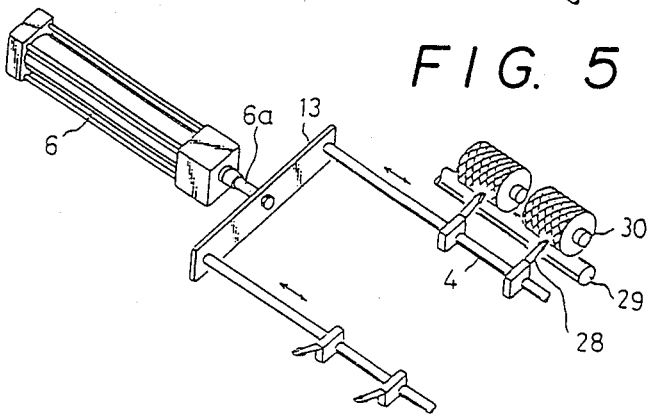

In FIG. 5, a piston rod 6*a* of the hydraulic cylinder 6 is directly connected to a bracket 13, which has a construction similar to that of the bracket 13 illustrated in FIG. 4. Accordingly, the traverse guides 28 are traversed to and fro along the bobbins 30 by actuating the piston rod 6*a* of the hydraulic cylinder 6.

According to the traverse devices illustrated in FIGS. 3 to 5, the traverse guides 28 can be stopped at any position by the means for reversible movement.

The method for winding a covered yarn of the present invention using the above-described apparatuses illustrated in FIGS. 1 to 5 will now be explained.

Figure 6:
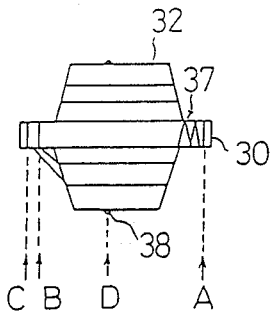
FIG. 6 is a schematic cross sectional view which will be used to explain the steps for winding the covered yarn of the present invention.

When the winding of the covered yarn 36 onto the winding bobbin 30 starts, the traverse guide 28 is stopped at a position A, i.e., the right end in FIG. 6, displaced outwardly from the normal winding region on the winding bobbin 30.

Under this condition, both an elastic yarn 23 to be a core yarn and a non-elastic yarn 33 are wrapped around the winding bobbin 30 at a position near the end position A and are engaged with the traverse guide 28.

Under these conditions, the covered yarn manufacturing machine is started. After the yarns wound near the position A on the winding bobbin 30 become a normal covered yarn 36, i.e., about one minute after start of the covered yarn manufacturing machine, the traverse guide 28 is moved along the winding bobbin 30 until it reaches the normal traversing region. During this movement, transfer tail windings 37 are formed on the winding bobbin 30.

At the normal traversing region, the traverse guide 28 is traversed and the covered yarn 36 is wound onto the winding bobbin 30.

A yarn length counter (not shown) is provided to detect the timing when the non-elastic yarn 33 on the wrapping yarn bobbin 34 is almost consumed. Based on the detected signal by the counter, the traverse guide 28 is moved in a direction opposite to the original stop position A until it reaches a position B outside the normal traversing region. The traverse guide 28 is stopped at the position B. About five seconds after stop of the traverse guide 28, the entire covered yarn manufacturing machine is stopped. Because of this operation, some turns are overlapped at the position B where the traverse guide 28 stops.

The peripheral speed when the covered yarn 36 is wound onto the winding bobbin 30 at the position B is smaller than that when it is wound onto the package 32, however, no substantial problems occur since the covered yarn has a very large elasticity.

Under the conditions, replacement of the wrapping yarn bobbins is done. More specifically, in the covered yarn manufacturing machine illustrated in FIG. 1, both the consumed wrapping yarn bobbins 34 are replaced by new wrapping yarn bobbins 34. Further, in the covered yarn manufacturing machine illustrated in FIG. 2, providing that the non-elastic yarn 33 is supplied, for example, from the lower wrapping yarn bobbins 34 in the first instance, the non-elastic yarn 33 is supplied from the upper wrapping yarn bobbins 34 in this instance.

After replacement of the wrapping yarn bobbin 34, the covered yarn manufacturing machine is restarted in a manner similar to the foregoing manner. More specifically, the elastic yarn 23 to be a core yarn and the non-elastic yarn 33 are wrapped around the winding bobbin 30 at a position corresponding to the end position B where the traverse guide 28 is stopped outside the normal traversing region.

Under these conditions, the covered yarn manufacturing machine is started. After the yarns wound near the position B on the winding bobbin 30 becomes a normal covered yarn 36, the traverse guide 28 is moved toward the normal traversing region, i.e., to the right in FIG. 6, along the winding bobbin 30 until it reaches the normal traversing region where the covered yarn 36 is traversed and wound onto the winding bobbin 30.

As the covered yarn 36 is wound onto the winding bobbin 30, the traverse guide 28 is again moved in a direction toward the above-described stop position B from the normal traversing region, when the non-elastic yarn 33 on the wrapping yarn bobbin 34 is almost consumed.

In this case, it is preferred that the traverse guide 28 is stopped at a position C nearer to the end of the winding bobbin 30 than the position B, in other words, the position C locates at the left of the position B in FIG. 6. Then, the entire covered yarn manufacturing machine is stopped. Because of this operation, some turns are overlapped at the position C where the traverse guide 28 stops. It is preferred that the position C is so selected relative to the former position B as described above, because the overlapping turns at this moment does not overlie on the previous overlapping turns.

Under the conditions, replacement of the wrapping yarn bobbins 34 is performed in a foregoing manner. After replacement of the wrapping yarn bobbin 34, the covered yarn manufacturing machine is restarted in a manner similar to the foregoing manner.

The above-described procedure is repeated, and the covered yarn is wound onto the winding bobbin 30 forming some layers. It is preferred that upon completion of winding, the traverse guide 28 is stopped at a stop position D which locates within the normal traversing region so that bunch windings 38 are formed on the package 32 in order to facilitate easy finding of the yarn end.

When the winding of the covered yarn 36 is completed, the package 32 is unloaded from the covered yarn manufacturing machine. Then, the overlapped windings, which was formed at the positions B and C upon replacement of the wrapping yarn bobbins 34, are removed.

In this case, the yarns project from the respective yarn layers in the package 32 toward the end of the winding bobbin 30 and are overlapped at the positions B and C, respectively. Further, the thus wound covered yarn 36 are discontinuous at every replacement of the wrapping yarn bobbins 34. Accordingly, the overlapped windings at positions B and C are readily found and easily removed.

Figure 7:
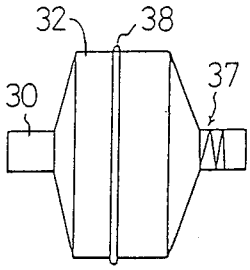
FIG. 7 is a front view of a manufactured package which was wound in accordance with the method of the present invention.
Figure 8:
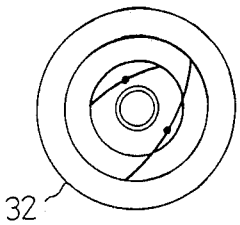
FIG. 8 is a left side view of the package illustrated in FIG. 7.

Then, the ends are knotted manually or by a knotting machine. FIG. 8 illustrates an example of the knots, i.e., the tail end of the first layer and the leading end of the second layer are knotted, and similarly, the tail end of the second layer and the leading end of the third layer are knotted. Thus, a complete package is formed as illustrated in FIG. 7 which is a front view and in FIG. 8 which is a side view.

According to the present invention, a plurality of covered yarn are successively wound forming layers on a covered yarn package, and the amount of the covered yarn package wound on a winding bobbin can be enlarged without increasing the respective winding amount of a wrapping yarn bobbin.

As a result, according to the present invention, any rewinding process independent from the covered yarn manufacturing process is no more unnecessary. Further, since increase of the amount of the wrapping yarn bobbin is unnecessary, there occur no problems when the covered yarn manufacturing machine is sped up.

Further, according to the present invention, since ends of the wrapping yarn bobbins locate outside the portion corresponding to the normal traversing region, knotting operation of the yarn ends can be done easily. In addition, the knots do not locate within the wound package but locate outside the body of the package. If the yarn is withdrawn toward the knots, i.e., to the left in FIG. 7, the withdrawn yarn does not entangle with the knots, and accordingly, the tension in the withdrawn yarn is not increased. Therefore, during the withdrawal of the covered yarn, the yarn quality is not deteriorated, and the yarn breakage does not occur.

What is claimed is:

1. A method for winding a covered yarn in a covered yarn manufacturing machine, wherein a non-elastic yarn supplied from a wrapping yarn bobbin is wrapped around a core yarn made of an elastic yarn to form a covered yarn, and said covering yarn is traversed by a traverse guide along a winding bobbin and is wound around said winding bobbin, which method further comprises:

displacing said traverse guide along said winding bobbin to a position outside a normal traversing region when said non-elastic yarn on said wrapping yarn bobbin is almost consumed;

thereafter, stopping said covered yarn manufacturing machine;

replacing said consumed wrapping yarn bobbin of non-elastic yarn by a new wrapping yarn bobbin of non-elastic yarn; and restarting said covered yarn manufacturing machine wherein the steps of displacing, stopping, replacing and restarting are repeated with regard to one winding bobbin and, wherein a subsequent position to which said traverse guide is displaced is a position on the side of a previous starting which is away from the yarn package as said steps are repeated.

2. A method for winding a covered yarn in a covered yarn manufacturing machine according to claim 1, which further comprises stopping said traverse guide in said normal traversing region after repeat of said steps.

* * * * *